US008137530B2

(12) United States Patent
Tano et al.

(10) Patent No.: US 8,137,530 B2
(45) Date of Patent: Mar. 20, 2012

(54) PROCESS FOR PRODUCING PETROLEUM COKE

(75) Inventors: Tamotsu Tano, Yamaguchi (JP); Takashi Oyama, Yamaguchi (JP); Kazuhisa Nakanishi, Yamaguchi (JP); Toshiyuki Oda, Yamaguchi (JP); Keiji Higashi, Yamaguchi (JP)

(73) Assignee: Nippon Petroleum Refining Co., Ltd., Tokyo (JP)

( * ) Notice: Subject to any disclaimer, the term of this patent is extended or adjusted under 35 U.S.C. 154(b) by 104 days.

(21) Appl. No.: 12/664,504

(22) PCT Filed: Apr. 15, 2008

(86) PCT No.: PCT/JP2008/057650

§ 371 (c)(1),
(2), (4) Date: Dec. 14, 2009

(87) PCT Pub. No.: WO2009/001610

PCT Pub. Date: Dec. 31, 2008

(65) Prior Publication Data

US 2010/0181228 A1 Jul. 22, 2010

(30) Foreign Application Priority Data

Jun. 22, 2007 (JP) ..... 2007-165376

(51) Int. Cl.
*C10B 55/00* (2006.01)

(52) U.S. Cl. ..... 208/14; 208/22; 208/23; 208/50; 208/53

(58) Field of Classification Search ..... 208/14, 208/50

See application file for complete search history.

(56) References Cited

U.S. PATENT DOCUMENTS

| | | | | |
|---|---|---|---|---|
| 4,075,084 | A | 2/1978 | Skripek et al. | |
| 4,130,475 | A | 12/1978 | Cameron et al. | |
| 4,178,229 | A | 12/1979 | McConaghy et al. | |
| 4,213,846 | A | 7/1980 | Sooter et al. | |
| 4,334,960 | A | 6/1982 | Brandenberger et al. | |
| 5,028,311 | A * | 7/1991 | Shigley et al. | 208/131 |
| 5,167,796 | A | 12/1992 | Didchenko et al. | |
| 5,286,371 | A * | 2/1994 | Goval et al. | 208/131 |
| 5,900,189 | A | 5/1999 | Kawano et al. | |
| 5,954,949 | A * | 9/1999 | Ohsol et al. | 208/131 |
| 6,841,062 | B2 * | 1/2005 | Reynolds | 208/89 |
| 6,882,517 | B2 | 4/2005 | Tano et al. | |
| 6,884,546 | B1 | 4/2005 | Fujita et al. | |
| 7,371,317 | B2 * | 5/2008 | Newman et al. | 208/131 |
| 7,604,731 | B2 * | 10/2009 | Bhattacharyya et al. | 208/67 |
| 7,759,289 | B2 | 7/2010 | Iwasaki et al. | |
| 2006/0032788 | A1 * | 2/2006 | Etter | 208/131 |
| 2006/0060506 | A1 * | 3/2006 | Siskin et al. | 208/131 |
| 2008/0304206 | A1 | 12/2008 | Tano et al. | |
| 2009/0237860 | A1 | 9/2009 | Oyama et al. | |
| 2009/0268375 | A1 | 10/2009 | Oyama et al. | |

FOREIGN PATENT DOCUMENTS

| | | | |
|---|---|---|---|
| EP | 1675141 | A1 | 6/2006 |
| JP | 54-122301 | A | 9/1979 |
| JP | 54-153802 | A | 12/1979 |
| JP | 55-016087 | A | 2/1980 |
| JP | 57073075 | A | 5/1982 |
| JP | 58-040386 | A | 3/1983 |
| JP | 04-145193 | A | 5/1992 |
| JP | 05-105881 | A | 4/1993 |
| JP | 05-163491 | A | 6/1993 |
| JP | 05202362 | A | 8/1993 |
| JP | 07003267 | A | 1/1995 |
| JP | 2002110157 | A | 4/2002 |
| JP | 2003051430 | A | 2/2003 |
| JP | 2003272622 | A | 9/2003 |
| JP | 2004185975 | A | 7/2004 |
| JP | 2004247433 | A | 9/2004 |
| JP | 2005123462 | A | 5/2005 |
| SU | 1456447 | A1 | 2/1989 |
| WO | 2004011371 | A1 | 2/2004 |

OTHER PUBLICATIONS

Iwashita et al: "Specification for a standard procedure of X-ray diffraction measurements on carbon materials"; Carbon; 42; pp. 701-714 (2004).

U.S. Office Action issued Sep. 29, 2011 in U.S. Appl. No. 13/157,916.

Yuzo Sanada et al.: "Basic Carbonization Engineering"; Ohmsha Ltd.; pp. 146-147 (1980).

U.S. Office Action issued Jun. 28, 2010 in U.S. Appl. No. 12/094,222.

(Continued)

*Primary Examiner* — Ellen McAvoy

(74) *Attorney, Agent, or Firm* — Panitch Schwarze Belisario & Nadel LLP

(57) ABSTRACT

A process is provided for producing petroleum coke that is high in strength and sufficiently small in thermal expansion coefficient and sufficiently suppressed from puffing. The process includes coking a feedstock containing a first heavy oil having a sulfur content of 1.0 percent by mass or less, a nitrogen content of 0.5 percent by mass or less, and an aromatic index of 0.1 or greater, produced by hydrodesulfurizing a heavy oil with a sulfur content of 1 percent by mass or more under conditions (1) where the total pressure is 10 MPa or greater and less than 16 MPa and the hydrogen partial pressure is 5 MPa or greater and 16 MPa or less or conditions (2) where the total pressure is 20 MPa or greater and 25 MPa or less and the hydrogen partial pressure is greater than 20 MPa and 25 MPa or less, and a second heavy oil with an aromatic index of 0.3 or greater and an initial boiling point of 150° C. or higher.

3 Claims, No Drawings

OTHER PUBLICATIONS

U.S. Office Action issued Sep. 2, 2010 in U.S. Appl. No. 12/158,165.

"Prodecure for the measurements of lattice parameters and crystallite sizes of carbon materials by X-ray diffraction", The 117 Committee of the Japan Society for the Promotion of Sciences; No. 221; p. 52 (2006).

U.S. Office Action issued Dec. 23, 2010 in U.S. Appl. No. 12/094,222.

U.S. Office Action issued Sep. 15, 2011 in U.S. Appl. No. 13/158,008.

* cited by examiner

PROCESS FOR PRODUCING PETROLEUM COKE

CROSS-REFERENCE TO RELATED APPLICATION

This application is a section 371 of International Application No. PCT/JP2008/057650, filed Apr. 15, 2008, which was published in the Japanese language on Dec. 31, 2008 under International Publication No. WO 2009/001610 A1 and the disclosure of which is incorporated herein by reference.

FIELD OF THE INVENTION

The present invention relates to a process of producing petroleum coke and petroleum coke produced thereby.

BACKGROUND OF THE INVENTION

Needle coke is used as an aggregate for a graphite electrode used in electric furnace steel making processes and is generally produced using petroleum-based heavy oil or coal tar as the raw material. In a process of producing a graphite electrode, coke particles and a binder pitch are blended at a predetermined ratio, and then kneaded while being heated, and extrusion-molded thereby producing a green electrode. The green electrode is calcined to be graphitized and fabricated thereby producing a graphite electrode product.

The graphite electrode is desirously lower in coefficient of thermal expansion (CTF) because it is used under severe conditions such as high temperature conditions. That is, a graphite electrode with a lower CTF is less consumed and thus can reduce the cost of the electric furnace steel making.

The above-mentioned graphitization is a process wherein a green electrode is heated at a temperature of about 3000° C. and a direct current flow furnace (LWG furnace) is generally used. However, graphitization carried out in the LWG furnace accelerates the temperature elevating rate therein and thus facilitates the generation of gas. As the result, an abnormal expansion phenomenon, so-called puffing is likely to occur. Puffing lowers the density of an electrode and also sometimes breaks the electrode. However, the accelerated temperature elevating rate has been demanded with the objective of reducing costs, and there is a strong demand for needle coke with higher strength, lower expansion rate and lower puffing characteristics so that it can withstand such an accelerated temperature elevating rate.

Now, a method has been studied wherein coefficient of thermal expansion and puffing characteristics are controlled upon production of needle coke, and there have been proposed various methods. For example, Patent Document 1 discloses a method wherein a coal tar pitch from which quinoline-insolubles has been substantially removed is blended with an oligomer adjusted in polymerization degree and coked by the delayed coking method. Patent Document 2 discloses a method wherein a coal tar-based heavy oil and a petroleum-based heavy oil are blended at a specific ratio such that the nitrogen and sulfur contents are to be 1.0 percent by mass or less and 1.4 percent by mass or less, respectively to prepare a feedstock which is then placed into a delayed coker to produce a green coke, which is then calcined at a temperature of 700 to 900° C. and cooled, and again calcined at a temperature of 1200 to 1600° C. Patent Document 3 discloses a method wherein upon production of coal tar by rapid thermal cracking of coal, the thermal cracking temperature in the reactor is kept at 750° C. or higher and the residence time of the thermal cracked product in the reactor is 5 seconds or shorter thereby producing a liquid product which or the pitch of which is then carbonized. Patent Document 4 discloses a method wherein needle coke is produced by subjecting a petroleum-based heavy oil alone or a mixture thereof with a coal tar-based heavy oil from which quinoline-insolubles have been removed, as the feedstock to delayed coking and thereupon the petroleum-based heavy oil has been so adjusted that the content of particles such as ash therein is to be from 0.05 to 1 percent by mass.

(Patent Document 1) Japanese Patent Laid-Open Publication No. 5-105881

(Patent Document 2) Japanese Patent Laid-Open Publication No. 5-163491

(Patent Document 3) Japanese Patent Laid-Open Publication No. 5-202362

(Patent Document 4) Japanese Patent Laid-Open Publication No. 7-3267

DISCLOSURE OF THE INVENTION

However, any of the methods described in Patent Documents 1 to 4 is not necessarily sufficient in lowering coefficient of thermal expansion or inhibition of puffing and it is actual situation that the quality of the coke produced by these methods has not reached to the level required for an aggregate for a graphite electrode used in an electric furnace steel making process. Upon graphitization, coke is subjected to a heat treatment at about 3000° C., and the resulting graphite is used under sever conditions such as a high temperature atmosphere and thus is largely broken and worn. In order to reduce such breakage or wear, the raw material coke (needle coke) is demanded to be high in strength and low in thermal expansion rate. Further, graphitization is demanded to be carried out at an accelerated temperature elevation rate in order to reduce costs, and thus the raw material coke (needle coke) is required to have higher strength and lower thermal expansion rate so that it can withstand such an accelerated temperature elevating rate.

In the formation mechanism of needle coke, heavy oil undergoes thermal cracking and condensation reaction when subjected to a treatment at high temperature, resulting in the formation of liquid crystal spherules so-called mesophase, which spherules are then combined to each other and then formed into large liquid crystals that are intermediate products and referred to as bulk mesophase. During the process where the bulk mesophase is carbonized and solidified, promoting polycondensation, needle coke that is aligned and low in thermal expansion rate is produced if an adequate amount of gas is generated.

Meanwhile, the production of a graphite electrode involves a heat treatment at around 3000° C., and abnormal expansion accompanied with gas generation during the production occurs and is referred to as "puffing". In order to diminish such puffing, it is important to decrease the sulfur and nitrogen contents of needle coke and in particular control the crystal structure thereof. That is, in order to produce needle cokes of high quality, it is necessary to generate gas in such an adequate amount that excellent bulk mesophase is formed during thermal cracking and polycondensation of the feedstock and crystals are aligned during carbonization and solidification by polycondensation of the bulk mesophase.

In general, a bottom oil of a fluid catalytic cracked oil, a residue of a vacuum-distilled low sulfur crude oil, or a mixture thereof is used to produce petroleum needle coke. A bottom oil of a fluid catalytic cracked oil, which is then hydrodesulfurized may also be used. However, the use of such feedstocks also has failed to produce needle coke with higher strength, low thermal expansion rate and low puffing. That is, when only a bottom oil of a fluid catalytic cracked oil is used to produce needle coke, excellent bulk mesophase is formed, but gas adequate for carbonization and solidification can not be generated, resulting in poor crystal alignment and thus in failure to obtain a lower thermal expansion rate. When a residue produced by vacuum distillation is used, an adequate amount of gas is generated upon carbonization and solidification but the asphaltene component contained in an amount of 10 percent or more in the residue adversely affects the formation of bulk mesophase, resulting in a failure of exhibition of a lower thermal expansion rate. Further, no improvement in thermal expansion rate was not able to be achieved using a mixture of a bottom oil of a fluid catalytically cracked oil and a residue resulting from vacuum distillation of a low sulfur crude oil.

As the result of extensive study and research, the inventors of the present invention found a process of producing needle coke that satisfies a lower thermal expansion rate, lower puffing characteristics and a higher strength all together, all of which have not been able to be achieved, by mixing at least two types of specific heavy oils while utilizing the formation mechanism of needle coke, and then accomplished the present invention.

That is, the present invention relates to a process of producing petroleum coke comprising coking a feedstock comprising a first heavy oil with a sulfur content of 1.0 percent by mass or less, a nitrogen content of 0.5 percent by mass or less, and an aromatic index of 0.1 or greater, produced by hydrodesulfurizing a heavy oil with a sulfur content of 1 percent by mass or more under conditions (1) where the total pressure is 10 MPa or greater and less than 16 MPa and the hydrogen partial pressure is 5 MPa or greater and 16 MPa or less or conditions (2) where the total pressure is 20 MPa or greater and 25 MPa or less and the hydrogen partial pressure is greater than 20 MPa and 25 MPa or less, and a second heavy oil with an aromatic index of 0.3 or greater and an initial boiling point of 150° C. or higher.

The present invention also relates to the foregoing process wherein the first heavy oil has a saturate content of 50 percent by mass or more and a total of a asphaltene content and a resin content of 10 percent by mass or less.

The present invention also relates to petroleum coke produced by the foregoing process.

The present invention also relates to the foregoing petroleum coke with a microstrength value of 34 percent or greater, a sulfur content of 0.5 percent by mass or less, and a nitrogen content of 0.3 percent by mass or less.

EFFECTS OF THE INVENTION

According to the present invention, there is provided petroleum coke that is high in strength, sufficiently low in thermal expansion coefficient and sufficiently suppressed from puffing and a process of producing such petroleum coke.

BEST MODE OF CARRYING OUT THE INVENTION

The present invention will be described in more detail below.

In the present invention, coking of a feedstock comprising a specific first heavy oil and a specific second heavy oil enables the production of petroleum coke that is high in strength, sufficiently low in thermal expansion coefficient and sufficiently suppressed from puffing.

The first heavy oil used in the present invention is a heavy oil with a sulfur content of 1.0 percent by mass or less, a nitrogen content of 0.5 percent by mass or less, and an aromatic index of 0.1 or more, produced by hydrodesulfurizing a heavy oil with a sulfur content of 1 percent by mass or more under conditions (1) where the total pressure is 10 MPa or greater and less than 16 MPa and the hydrogen partial pressure is 5 MPa or greater and 16 MPa or less or conditions (2) where the total pressure is 20 MPa or greater and 25 MPa or less and the hydrogen partial pressure is greater than 20 MPa and 25 MPa or less.

The sulfur content of the first heavy oil is necessarily 1.0 percent by mass or less, preferably 0.8 percent by mass or less, more preferably 0.5 percent by mass or less because if the sulfur content is more than 1.0 percent by mass, the content of sulfur remaining in the resulting coke would be increased and thus puffing likely occurs. The nitrogen content is necessarily 0.5 percent by mass or less, preferably 0.3 percent by mass or less, more preferably 0.2 percent by mass or less because if the nitrogen content is more than 0.5 percent by mass, the content of nitrogen remaining in the resulting coke would be increased and thus puffing likely occurs. The aromatic index of the first heavy oil is necessarily 0.1 or more, preferably 0.12 or more, more preferably 0.15 or more because if the aromatic index is less than 0.1, the yield of the resulting coke would be decreased.

The saturate content of the first heavy oil is preferably 50 percent by mass or more, more preferably 60 percent by mass or more. The total of the contents of the asphaltene and resin of the first heavy oil is preferably 10 percent by mass or less, more preferably 8 percent by mass or less.

The term "sulfur content" used herein means the values measured in accordance with JIS K 2541 for oil and JIS M8813 for coke, respectively. The term "nitrogen content" used herein means the values measured in accordance with JIS K2609 for oil and JIS M8813 for coke, respectively. The terms "saturate content", "asphalten content" and "resin content" used herein means the values measured using a thin-layer chromatography. The term "aromatic index" indicates the fraction of aromatic hydrocarbon in a substance determined by the Knight method ("Characterization of Pitch II. Chemical Structure" Yokono and Sanada (Tanso, No. 105, pages 73-81, 1981).

Now, description will be given of the operation conditions of hydrodesulfurization for producing the first heavy oil.

Hydrodesulfurization for producing the first heavy oil is carried out under conditions (1) where the total pressure is 10 MPa or greater and less than 16 MPa and the hydrogen partial pressure is 5 MPa or greater and 16 MPa or less, preferably the total pressure is 11 MPa or greater and 15 MPa or less and the hydrogen partial pressure is 6 MPa or greater and 14 MPa or less or conditions (2) where the total pressure is 20 MPa or greater and 25 MPa or less and the hydrogen partial pressure is greater than 20 MPa and 25 MPa or less, preferably the total pressure is 21 MPa or greater and 24 MPa or less and the hydrogen partial pressure is 20.5 MPa or greater and 23.5 MPa or less. If the hydrogen partial pressure is less than 5 MPa, a heavy oil that is useful as a feedstock for petroleum coke can not be produced because hydrogenation would be insufficient.

There is no particular restriction on conditions for desulfurization other than the total pressure and hydrogen partial pressure. However, various conditions are preferably set as follows. That is, the desulfurization temperature is preferable from 300 to 500° C., more preferably from 350 to 450° C. The hydrogen/oil ratio is preferably from 400 to 3000 NL/L, more preferably from 500 to 1800 NL/L. The liquid hourly space velocity (LHSV) is preferably from 0.1 to 3 $h^{-1}$, more preferably from 0.15 to 1.0 $h^{-1}$, more preferably from 0.15 to 0.75 $h^{-1}$.

Examples of a catalyst for desulfurization (desulfurization catalyst) include Ni—Mo catalysts, Co—Mo catalysts, and combinations of these catalysts. These catalyst may be commercially available products.

There is no particular restriction on the heavy oil that is used as the feedstock for the first heavy oil as long as the sulfur content meets the predetermined conditions. Examples of the heavy oil include crude oil, atmospheric or vacuum distillation residue produced by distillation of crude oil, visbreaking oil, tar sand oil, shale oil, and mixed oils thereof. Among these oils, atmospheric or vacuum distillation residue is preferably used. The sulfur content of the feedstock used as the raw material oil for the first heavy oil is necessarily 1 percent by mass or more, preferably 1.2 percent by mass or more. There is no particular restriction on the upper limit of the sulfur content. However, the upper limit is preferably 5 percent by mass or less.

The second heavy oil used in the present invention is a heavy oil with an initial boiling point of 150° C. or higher and an aromatic index of 0.3 or greater. The initial boiling point is necessarily 150° C. or higher, preferably 170° C. or higher because if the initial boiling point is lower than 150° C., the yield of the resulting coke would be decreased. The aromatic index is necessarily 0.3 or greater, preferably 0.4 or greater because if the aromatic index is less than 0.3, the yield of the resulting coke would be decreased. The upper limit of the aromatic index is preferably 0.9 or less, more preferably 0.8 or less.

Although there is no particular restriction on the sulfur or nitrogen content of the second heavy oil, the sulfur content is preferably 1.0 percent by mass or less and the nitrogen content is 0.5 percent by mass or less.

The second heavy oil may be produced by subjecting a predetermined feedstock to fluid catalytic cracking. The term "fluidized catalytic cracking" means a process of cracking a high boiling point distillate with a solid acid catalyst and is also referred to as "FCC".

There is no particular restriction on the feedstock for the second heavy oil as long as a heavy oil with an initial boiling point of 150° C. or higher and an aromatic index of 0.3 or greater can be produced through fluidized catalytic cracking. However, it is preferred to use hydrocarbon oils with a density at 15° C. of 0.8 g/$cm^3$ or greater. Examples of such hydrocarbon oils include atmospheric distillation residue, vacuum distillation residue, shale oil, tar sand bitumen, Orinoco tar, coal liquid, and heavy oils produced by hydro-refining these oils. Alternatively, in addition to these oils, the second heavy oil may contain relatively light oils such as straight-run gas oil, vacuum gas oil, desulfurized gas oil, and desulfurized vacuum gas oil. In the present invention, it is particularly preferred to use vacuum gas oil and desulfurized vacuum gas oil.

There is no particular restriction on the conditions for fluidized catalytic cracking as long as a heavy oil with an initial boiling point and aromatic index satisfying the above-described requirements. For example, preferably the reaction temperature is from 480 to 550° C., the total pressure is from 100 to 300 KPa, the catalyst/oil ratio is from 1 to 20, and the contact time is from 1 to 10 seconds.

Examples of catalysts used in the fluidized catalytic cracking include silica/alumina catalyst, zeolite catalyst, and those supporting a metal such as platinum (Pt) on these catalysts. These catalysts may be those commercially available.

Other than those produced through fluid catalytic cracking, the second heavy oil may be ethylene tar. The ethylene tar is referred to as that obtained at the bottom of the tower of a thermal cracking unit for naphtha producing olefins such as ethylene and propylene. That is, in a tube type heating furnace process that is a typical example, i.e., a steam cracking process, naphtha is introduced together with steam into a thermal cracking furnace and thermally cracked at a temperature on the order of 760 to 900° C., and the resulting hydrocarbons are cooled rapidly and introduced into a fractionator thereby producing ethylene tar from the bottom thereof.

In the present invention, a feedstock comprising the above-described first and second heavy oils is coked thereby producing stably petroleum coke that is high in strength, sufficiently low in thermal expansion coefficient and sufficiently suppressed from puffing. There is no particular restriction on the mix ratio of the first and second heavy oils in the feedstock. However, the first heavy oil is present in an amount of 1 to 50 percent by mass, preferably 5 to 50 percent by mass on the basis of the total amount of the feedstock.

The method of coking the above-described feedstock is preferably a delayed coking method. More specifically, the feedstock is heated under pressure in a delayed coker thereby producing green coke, which is then calcined in a rotary kiln or a shaft kiln to be converted to needle coke. The pressure and temperature in the delayed coker are preferably from 300 to 800 KPa and from 400 to 600° C., respectively. The calcination temperature is preferably from 1200 to 1500° C.

The resulting petroleum coke has a microstrength of 34 percent or greater, a sulfur content of 0.5 percent by mass or less, and a nitrogen content of 0.3 percent by mass or less. The microstrength is necessarily 34 percent or greater, preferably 36 percent or greater because if the microstrength is less than 34 percent, the electrode becomes fragile during the production thereof. The term "microstrength" used herein is an index that has been conventionally used to express the strength of coke and measured in accordance with the method of H. E. Blayden. The specific measuring method is as follows. To a steel cylinder (inner diameter: 25.4 mm, length: 304.8 mm), 2 g of a sample with a mesh size of 20 to 30 and 12 steel balls with a diameter of 5/16 inches (7.9 mm) are placed. The vertical plane is rotated in the perpendicular direction to the cylinder at 25 rpm 800 times (i.e., the cylinder is rotated from its upright position like a propeller about a horizontal rotation axis so that the cylinder turns upside down. Thereafter, the ground particles are sieved with a sieve with a mesh size of 48. The particle remaining the sieve are weighed and expressed in terms of percentage relative to the original weight of the sample.

The value of microstrength of the petroleum coke is usually within the range of 34 to 50 percent. As described above, the value of microstrength is a kind of index indicating a degree of grinding characteristics by a ball mill and measured in accordance with the method of H. E. Blayden. A value of 100 percent means that a material is not substantially crushed while a value of 0 percent means that a material is easily crushed. There are other indexes indicating the strength of coke, such as the results of a drum strength test or a shatter strength test. However, these tests are influenced by cracks in coke and indicate the strength of massive coke while the microstrength indicates the intrinsic strength of coke, i.e., the strength mainly derived from the strength of pore wall.

The sulfur content of the petroleum coke of the present invention is 0.5 percent by mass or less, preferably 0.3 percent by mass or less. A sulfur content of more than 0.5 percent by mass is not preferable because puffing likely occurs.

The nitrogen content of the petroleum coke of the present invention is 0.3 percent by mass or less, preferably 0.2 percent by mass or less. A nitrogen content of more than 0.3 percent by mass is not preferable because puffing likely occurs.

The thermal expansion rate of the petroleum coke of the present invention is desirously as low as possible, preferably $1.5\times10^{-6}$/° C. with the objective of suppressing of puffing.

Examples of the method of producing a graphite electrode product using the petroleum coke include those wherein a raw material that is a blend of the petroleum coke of the present invention and a binder pitch added thereto in a suitable amount is kneaded while being heated and then extruded thereby producing a green electrode, which is then graphitized by calcination and fabricated.

EXAMPLES

The present invention will be described in more details with reference to the following examples but is not limited thereto.

Example 1

An atmospheric distillation residue with a sulfur content of 3.0 percent by mass was hydrodesulfurized in the presence of a Ni—Mo catalyst thereby producing a hydrodesulfurized oil as a first heavy oil (hereinafter referred to as "hydrodesulfurized oil A"). The desulfurization was carried out under conditions where the total pressure was 15 MPa, the hydrogen partial pressure was 13 MPa, the temperature was 370° C., the hydrogen/oil ratio was 590 NL/L and the liquid hourly space velocity (LHSV) was 0.17 $h^{-1}$. The resulting hydrodesulfurized oil A had an initial boiling point of 190° C., a sulfur content of 0.3 percent by mass, and a nitrogen content of 0.1 percent by mass.

The aromatic index of hydrodesulfurized oil A determined by the Knight method using a $^{13}$C-NMR apparatus was 0.15. The saturate, asphaltene and resin contents determined by the TLC method were 60 percent by mass, 2 percent by mass, and 6 percent by mass, respectively.

A desulfurized vacuum gas oil (sulfur content: 500 ppm by mass, density at 15° C.: 0.88 g/cm$^3$) was subjected to fluidized catalytic cracking thereby producing a fluidized catalytic cracked residue as a second heavy oil (hereinafter referred to as "fluidized catalytic cracked residue A). The fluidized catalytic cracked residue A thus produced had an initial boiling point of 180° C., a sulfur content of 0.1 percent by mass, a nitrogen content of 0.1 percent by mass, and an aromatic index of 0.60.

Hydrodesulfurized oil A and fluidized catalytic cracked residue A were mixed at a mass ratio of 1:3 thereby producing a feedstock for coke. The feedstock was placed into a test tube and heated at atmospheric pressure and a temperature of 500° C. for 3 hours to be coked.

Next, the coke thus produced was calcined at a temperature of 1200° C. for 5 hours thereby producing calcined coke. The sulfur and nitrogen contents and microstrength of the resulting coke are set forth in Table 1 below.

The calcined coke was blended with 30 percent by mass of a coal-based binder pitch and formed into a cylindrical piece through an extruder. The piece was calcined at a temperature of 1000° C. for one hour in a muffle furnace. Thereafter, the coefficient of thermal expansion of the calcined piece was measured. Further, the piece was heated from room temperature to a temperature of 2800° C. and the degree of expansion during the heating was measured as puffing. The results are set forth in Table 1.

Example 2

Ethylene tar produced during cracking of naphtha was obtained as a second heavy oil from the bottom of a fractionator. The sulfur content, aromatic index and initial boiling point of the ethylene tar thus obtained were 0.1 percent by mass, 0.70, and 170° C., respectively.

Hydrodesulfurized oil A produced in Example 1 and the ethylene tar were mixed at a mass ratio of 1:2 thereby producing a feedstock for coke. The feedstock was placed into a test tube and heated at atmospheric pressure and a temperature of 500° C. for 3 hours to be coked.

Next, the coke thus produced was calcined at a temperature of 1200° C. for 5 hours thereby producing calcined coke. The sulfur and nitrogen contents and microstrength of the resulting coke are set forth in Table 1 below.

The calcined coke was blended with 30 percent by mass of a coal-based binder pitch and formed into a cylindrical piece through an extruder. The piece was calcined at a temperature of 1000° C. for one hour in a muffle furnace. Thereafter, the coefficient of thermal expansion of the calcined piece was measured. Further, the piece was heated from room temperature to a temperature of 2800° C. and the degree of expansion during the heating was measured as puffing. The results are set forth in Table 1.

Example 3

Hydrodesulfurized oil A produced in Example 1 and the ethylene tar obtained in Example 2 were mixed at a mass ratio of 1:3 thereby producing a feedstock for coke. The feedstock was placed into a test tube and heated at atmospheric pressure and a temperature of 500° C. for 3 hours to be coked.

The feedstock was placed into a test tube and heated at atmospheric pressure and a temperature of 500° C. for 3 hours to be coked.

Next, the coke thus produced was calcined at a temperature of 1200° C. for 5 hours thereby producing calcined coke. The sulfur and nitrogen contents and microstrength of the resulting coke are set forth in Table 1 below.

The calcined coke was blended with 30 percent by mass of a coal-based binder pitch and formed into a cylindrical piece through an extruder. The piece was calcined at a temperature of 1000° C. for one hour in a muffle furnace. Thereafter, the coefficient of thermal expansion of the calcined piece was measured. Further, the piece was heated from room temperature to a temperature of 2800° C. and the degree of expansion during the heating was measured as puffing. The results are set forth in Table 1.

Example 4

An atmospheric distillation residue with a sulfur content of 1.8 percent by mass was hydrodesulfurized in the presence of a Ni—Mo catalyst thereby producing a hydrodesulfurized oil as a first heavy oil (hereinafter referred to as "hydrodesulfurized oil B"). The desulfurization was carried out under conditions where the total pressure was 10.1 MPa, the hydrogen partial pressure was 6.9 MPa, the temperature was 410° C., the hydrogen/oil ratio was 500 NL/L and the liquid hourly space velocity (LHSV) was 0.15 $h^{-1}$. The resulting hydrodesulfurized oil B had a sulfur content of 0.3 percent by mass and a nitrogen content of 0.2 percent by mass.

The aromatic index of hydrodesulfurized oil B determined by the Knight method using a $^{13}$C-NMR apparatus was 0.21. The saturate, asphaltene and resin contents determined by the TLC method were 53 percent by mass, 2 percent by mass, and 7 percent by mass, respectively.

Hydrodesulfurized oil B and fluidized catalytic cracked residue A produced in Example 1 were mixed at a mass ratio of 1:3 thereby producing a feedstock for coke. The feedstock was placed into a test tube and heated at atmospheric pressure and a temperature of 500° C. for 3 hours to be coked.

Next, the coke thus produced was calcined at a temperature of 1200° C. for 5 hours thereby producing calcined coke. The sulfur and nitrogen contents and microstrength of the resulting coke are set forth in Table 1 below.

The calcined coke was blended with 30 percent by mass of a coal-based binder pitch and formed into a cylindrical piece through an extruder. The piece was calcined at a temperature of 1000° C. for one hour in a muffle furnace. Thereafter, the coefficient of thermal expansion of the calcined piece was measured. Further, the piece was heated from room temperature to a temperature of 2800° C. and the degree of expansion during the heating was measured as puffing. The results are set forth in Table 1.

Example 5

An atmospheric distillation residue with a sulfur content of 3.0 percent by mass was hydrodesulfurized in the presence of a Ni—Mo catalyst thereby producing a hydrodesulfurized oil as a first heavy oil (hereinafter referred to as "hydrodesulfurized oil C"). The desulfurization was carried out under conditions where the total pressure was 22 MPa, the hydrogen partial pressure was 20.5 MPa, the temperature was 370° C., the hydrogen/oil ratio was 590 NL/L and the liquid hourly space velocity (LHSV) was 0.17 $h^{-1}$. The resulting hydrodesulfurized oil C had a sulfur content of 0.2 percent by mass and a nitrogen content of 0.1 percent by mass.

The aromatic index of hydrodesulfurized oil C determined by the Knight method using a $^{13}C$-NMR apparatus was 0.13. The saturate, asphaltene and resin contents determined by the TLC method were 64 percent by mass, 1 percent by mass, and 6 percent by mass, respectively.

Hydrodesulfurized oil C and fluidized catalytic cracked residue A produced in Example 1 were mixed at a mass ratio of 1:3 thereby producing a feedstock for coke. The feedstock was placed into a test tube and heated at atmospheric pressure and a temperature of 500° C. for 3 hours to be coked.

Next, the coke thus produced was calcined at a temperature of 1200° C. for 5 hours thereby producing calcined coke. The sulfur and nitrogen contents and microstrength of the resulting coke are set forth in Table 1 below.

The calcined coke was blended with 30 percent by mass of a coal-based binder pitch and formed into a cylindrical piece through an extruder. The piece was calcined at a temperature of 1000° C. for one hour in a muffle furnace. Thereafter, the coefficient of thermal expansion of the calcined piece was measured. Further, the piece was heated from room temperature to a temperature of 2800° C. and the degree of expansion during the heating was measured as puffing. The results are set forth in Table 1.

Example 6

An atmospheric distillation residue with a sulfur content of 1.8 percent by mass was hydrodesulfurized in the presence of a Ni—Mo catalyst thereby producing a hydrodesulfurized oil as a first heavy oil (hereinafter referred to as "hydrodesulfurized oil D"). The desulfurization was carried out under conditions where the total pressure was 24 MPa, the hydrogen partial pressure was 22 MPa, the temperature was 370° C., the hydrogen/oil ratio was 640 NL/L and the liquid hourly space velocity (LHSV) was 0.15 $h^{-1}$. The resulting hydrodesulfurized oil D had a sulfur content of 0.2 percent by mass and a nitrogen content of 0.1 percent by mass.

The aromatic index of hydrodesulfurized oil D determined by the Knight method using a $^{13}C$-NMR apparatus was 0.14. The saturate, asphaltene and resin contents determined by the TLC method were 69 percent by mass, 1 percent by mass, and 5 percent by mass, respectively.

Hydrodesulfurized oil D and fluidized catalytic cracked residue A produced in Example 1 were mixed at a mass ratio of 1:3 thereby producing a feedstock for coke. The feedstock was placed into a test tube and heated at atmospheric pressure and a temperature of 500° C. for 3 hours to be coked.

Next, the coke thus produced was calcined at a temperature of 1200° C. for 5 hours thereby producing calcined coke. The sulfur and nitrogen contents and microstrength of the resulting coke are set forth in Table 1 below.

The calcined coke was blended with 30 percent by mass of a coal-based binder pitch and formed into a cylindrical piece through an extruder. The piece was calcined at a temperature of 1000° C. for one hour in a muffle furnace. Thereafter, the coefficient of thermal expansion of the calcined piece was measured. Further, the piece was heated from room temperature to a temperature of 2800° C. and the degree of expansion during the heating was measured as puffing. The results are set forth in Table 1.

Comparative Example 1

Hydrodesulfurized oil A produced in Example 1 was placed into a test tube and heated at atmospheric pressure and a temperature of 500° C. for 3 hours to be coked.

Next, the coke thus produced was calcined at a temperature of 1200° C. for 5 hours thereby producing calcined coke. The sulfur and nitrogen contents and microstrength of the resulting coke are set forth in Table 1 below.

The calcined coke was blended with 30 percent by mass of a coal-based binder pitch and formed into a cylindrical piece through an extruder. The piece was calcined at a temperature of 1000° C. for one hour in a muffle furnace. Thereafter, the coefficient of thermal expansion of the calcined piece was measured. Further, the piece was heated from room temperature to a temperature of 2800° C. and the degree of expansion during the heating was measured as puffing. The results are set forth in Table 1.

Comparative Example 2

Fluidized catalytic cracked residue A produced in Example 1 was placed into a test tube and heated at atmospheric pressure and a temperature of 500° C. for 3 hours to be coked.

Next, the coke thus produced was calcined at a temperature of 1200° C. for 5 hours thereby producing calcined coke. The sulfur and nitrogen contents and microstrength of the resulting coke are set forth in Table 1 below.

The calcined coke was blended with 30 percent by mass of a coal-based binder pitch and formed into a cylindrical piece through an extruder. The piece was calcined at a temperature of 1000° C. for one hour in a muffle furnace. Thereafter, the coefficient of thermal expansion of the calcined piece was measured. Further, the piece was heated from room temperature to a temperature of 2800° C. and the degree of expansion during the heating was measured as puffing. The results are set forth in Table 1.

Comparative Example 3

The ethylene tar produced in Example 2 was placed into a test tube and heated at atmospheric pressure and a temperature of 500° C. for 3 hours to be coked.

Next, the coke thus produced was calcined at a temperature of 1200° C. for 5 hours thereby producing calcined coke. The sulfur and nitrogen contents and microstrength of the resulting coke are set forth in Table 1 below.

The calcined coke was blended with 30 percent by mass of a coal-based binder pitch and formed into a cylindrical piece through an extruder. The piece was calcined at a temperature of 1000° C. for one hour in a muffle furnace. Thereafter, the coefficient of thermal expansion of the calcined piece was measured. Further, the piece was heated from room temperature to a temperature of 2800° C. and the degree of expansion during the heating was measured as puffing. The results are set forth in Table 1.

Comparative Example 4

A heavy oil produced by hydrodesulfurization wherein the hydrogen partial pressure was less than 5 MPa was used as a first heavy oil. That is, an atmospheric distillation residue with a sulfur content of 3.0 percent by mass was hydrodesulfurized in the presence of a Ni—Mo catalyst thereby producing a hydrodesulfurized oil as a first heavy oil (hereinafter referred to as "hydrodesulfurized oil E"). The desulfurization was carried out under conditions where the total pressure was 6 MPa, the hydrogen partial pressure was 4 MPa, the temperature was 370° C., the hydrogen/oil ratio was 590 NL/L and the liquid hourly space velocity (LHSV) was 0.17 $h^{-1}$. The resulting hydrodesulfurized oil E had an initial boiling point of 190° C., a sulfur content of 1.5 percent by mass, and a nitrogen content of 0.6 percent by mass.

The aromatic index of hydrodesulfurized oil E determined by the Knight method using a $^{13}$C-NMR apparatus was 0.25. The saturate, asphaltene and resin contents determined by the TLC method were 60 percent by mass, 5 percent by mass, and 7 percent by mass, respectively.

Hydrodesulfurized oil E and fluidized catalytic cracked residue A produced in Example 1 were mixed at a mass ratio of 1:3 thereby producing a feedstock for coke. The feedstock was placed into a test tube and heated at atmospheric pressure and a temperature of 500° C. for 3 hours to be coked.

Next, the coke thus produced was calcined at a temperature of 1200° C. for 5 hours thereby producing calcined coke. The sulfur and nitrogen contents and microstrength of the resulting coke are set forth in Table 1 below.

The calcined coke was blended with 30 percent by mass of a coal-based binder pitch and formed into a cylindrical piece through an extruder. The piece was calcined at a temperature of 1000° C. for one hour in a muffle furnace. Thereafter, the coefficient of thermal expansion of the calcined piece was measured. Further, the piece was heated from room temperature to a temperature of 2800° C. and the degree of expansion during the heating was measured as puffing. The results are set forth in Table 1.

As apparent from the results set forth in Table 1, coking of feedstocks wherein specific first and second heavy oils were mixed enabled the production of well-balanced needle cokes that are high in strength, low in thermal expansion rate and suppressed from puffing (Examples 1 to 6).

TABLE 1

| | Sulfur Content (mass %) | Nitrogen Content (mass %) | Micro-strength (%) | Thermal Exapanstion Rate ($\times 10^{-6}$) | Puffing (Δ %) |
|---|---|---|---|---|---|
| Example 1 | 0.2 | 0.1 | 38 | 1.2 | 0.1 |
| Example 2 | 0.2 | 0.1 | 39 | 1.2 | 0.1 |
| Example 3 | 0.1 | 0.1 | 38 | 1.3 | 0.1 |
| Example 4 | 0.3 | 0.1 | 39 | 1.2 | 0.1 |
| Example 5 | 0.2 | 0.1 | 38 | 1.2 | 0.1 |
| Example 6 | 0.2 | 0.1 | 37 | 1.2 | 0.1 |
| Comparative Example 1 | 0.5 | 0.3 | 36 | 1.8 | 0.6 |
| Comparative Example 2 | 0.1 | 0.1 | 33 | 1.8 | 0.1 |
| Comparative Example 3 | 0.1 | 0.1 | 33 | 2.0 | 0.1 |
| Comparative Example 4 | 0.6 | 0.4 | 36 | 2.1 | 0.6 |

Applicability in the Industry

The present invention provides petroleum coke that is high in strength and sufficiently small in thermal expansion coefficient and sufficiently suppressed from puffing and a process of producing the petroleum coke and thus has a large industrial value.

The invention claimed is:

1. A process of producing petroleum coke comprising: coking a feedstock comprising a first heavy oil comprising 1 to 50 percent by mass and a second heavy oil comprising 50 to 99 percent by mass based on a total amount of the feedstock:

wherein the first heavy oil has a sulfur content of 1.0 percent by mass or less, a nitrogen content of 0.5 percent by mass or less, an aromatic index of 0.1 to 0.21, a saturate content of 53 percent by mass or more and a total of an asphaltene content and a resin content of 10 percent by mass or less, and is produced by hydrodesulfurizing an atmospheric distillation residue or a vacuum distillation residue with a sulfur content of 1 percent by mass or more under conditions (1) where the total pressure is 10 MPa or greater and less than 16 MPa and the hydrogen partial pressure is 5 MPa or greater and 16 MPa or less or conditions (2) where the total pressure is 20 MPa or greater and 25 MPa or less and the hydrogen partial pressure is greater than 20 MPa and 25 MPa or less, and wherein the second heavy oil has an aromatic index of 0.4 to 0.9 and an initial boiling point of 150° C. or higher, and is produced by catalytic fluidized cracking a vacuum gas oil or a desulfurized vacuum gas oil.

2. A petroleum coke produced by the process according to claim 1.

3. The petroleum coke according to claim 1 wherein it has a microstrength value of 34 percent or greater, a sulfur content of 0.5 percent by mass or less, and a nitrogen content of 0.3 percent by mass or less.

* * * * *